United States Patent [19]

Röck et al.

[11] Patent Number: 4,654,932

[45] Date of Patent: Apr. 7, 1987

[54] HINGE

[75] Inventors: Erich Röck, Höchst; Helmut Rupprechter; Klaus Brüstle, both of Lauterach, all of Austria

[73] Assignee: Julius Blum Gesellschaft M.B.H., Höchst, Austria

[21] Appl. No.: 687,430

[22] Filed: Dec. 28, 1984

[30] Foreign Application Priority Data

Dec. 30, 1983 [AT] Austria ..... 4571/83
Oct. 19, 1984 [AT] Austria ..... 3338/84

[51] Int. Cl.[4] ..... E05D 7/12

[52] U.S. Cl. ..... 16/382; 16/245; 16/258

[58] Field of Search ..... 16/382, 383, 245, 232, 16/254, 324, 326, DIG. 43, 238, 246, 257, 258, 235, 242, 349, 352, 296, 253; 248/221.3, 222.1; 403/322, 325, 328

[56] References Cited

U.S. PATENT DOCUMENTS 2,644,504 7/1953 Vick ..... 403/325
3,013,297 12/1961 Ferry ..... 16/381
3,909,937 10/1975 McLean ..... 16/258
4,226,001 10/1980 Salice ..... 16/296
4,430,771 2/1984 Salice ..... 16/382

FOREIGN PATENT DOCUMENTS 2044096 3/1972 Fed. Rep. of Germany .
2460127 6/1976 Fed. Rep. of Germany .... 16/DIG. 43
2116627 9/1983 United Kingdom ..... 16/235

*Primary Examiner*—Donald R. Schran
*Assistant Examiner*—James L. Wolfe
*Attorney, Agent, or Firm*—Wenderoth, Lind & Ponack

[57] ABSTRACT

A hinge for an article of furniture includes a hinge arm which is fastenable to a mounting plate and adjustable when it has been anchored to the mounting plate. The hinge arm is held at the mounting plate by means of push button-like bolts. Such bolts may be designed as part of an intermediate member or directly as joint- and depth adjustment screws and be mounted directly in the hinge arm. A leg spring or a slide acted upon by a leg spring is mounted in the mounting plate to hold the bolts.

13 Claims, 13 Drawing Figures

HINGE

BACKGROUND AND FIELD OF THE INVENTION

The invention relates to a hinge comprising a hinge arm mountable on a mounting plate and lockable on the mounting plate by means of a spring-activated catch mechanism.

According to the known state of the art, the hinge arm is held on the mounting plate generally by means of two screws. In this arrangement, one screw is mounted in a female thread in the mounting plate and projects through an elongated hole in the hinge arm, thus clamping the hinge arm onto the mounting plate. Such screw also serves for in the direction of the depth of the joint. The second screw, which is also called joint adjustment screw, is mounted in a female thread of the hinge arm and projects with its head into a recess of the mounting plate, or abuts on the mounting plate. The hinge arm has a U-shaped profile.

It is also known to fasten the hinge arm in such a way that lateral flanges of the hinge arm are provided with inwardly projecting edges by means of which the hinge arm is insertable into lateral grooves of the mounting plate. Generally, the hinge arm is fixed by means of a clamping or spreader screw.

DESCRIPTION OF THE PRIOR ART

A hinge is known from DE No. A 30 26 796 in which a spring catch mechanism is provided on the hinge arm or on the mounting plate. For mounting, the hinge arm is pushed onto the mounting plate, projections of the hinge arm extending into lateral recesses of the mounting plate. The hinge arm is displaceable over a certain part of the length of the mounting plate. An intermediate plate is fastened to the mounting plate by means of a screw, such intermediate plate having notches in which the catch mechanism of the hinge arm engages, when the latter-mentioned has been pushed onto the mounting plate.

This kind of hinge facilitates mounting of a furniture door on the body of the piece of furniture.

When assembling the piece of furniture, the mounting plates of the hinges are fixed to the furniture side walls or to intermediate walls of the piece of furniture, while the hinge casings are inserted into bores of the furniture door. After assembling the body of the piece of furniture, the furniture doors with the hinge arms are hung onto the mounting plates. During this operation, first the door must be held, and second the hinge arm, which is to be pushed onto the mounting plate, must be held as well. This operation is facilitated, if no further screw need be fastened.

Although efforts have been made to keep the displacement paths short, it may occur with conventional hinges, whose hinge arm is inserted into lateral guide means of the mounting plate, in particular in the case of very high doors which are carried by many hinges, that the hinge arm tilts with respect to the mounting plate.

Moreover, a depth adjustment of the hinge arm is possible in a hinge of the afore-mentioned kind, but this adjustment requires in some cases that the hinge arm is dismounted from the mounting plate.

SUMMARY OF THE INVENTION

It is the object of the invention to improve a hinge in which the hinge arm is fixed on the mounting plate by means of a spring catch mechanism in such a manner that mounting of the hinge arm is further facilitated and that tilting of the hinge arm with respect to the mounting plate is completely eliminated. Apart from this improvement, the usual adjustments in the depth and in the direction of the door joint are possible with the hinge according to the invention.

According to the invention, this is achieved in that at least one, preferably two, push button-like bolts are held on the hinge arm, such bolts being insertable into the mounting plate vertically to the mounting plane of the same, and whereby the catch mechanism, whose tensioning forces are aligned in a plane parallel to the mounting plane of the mounting plate, engages in lateral catch notches or the like of the bolts.

When the hinge arm is mounted on the mounting plate, the hinge arm only need be set upon the mounting plate, which can in case of several hinges arranged over the height of the door be done simultaneously with each hinge arm, whereupon the hinge arms are pushed onto the mounting plates by hand and are so instantly locked.

It is preferably provided that the catch mechanism is formed by a slide mounted in the mounting plate and having holes through which the bolts project, and that the slide engages in tapered or reduced diameter portions of the bolts which form the catch notches.

The slide is provided with a handle at its rear end. To release the hinge arm from the mounting plate, the handle of the slide can be pulled backwards so that the bolts can be moved from the holes of the slide through which they project in the mounted position.

A further embodiment of the invention provides that the catch mechanism is formed by a leg spring mounted in the mounting plate, the tensioning force of the leg spring being aligned in a plane parallel to the mounting plane of the mounting plate, and that the leg spring holds the bolts, which project into the mounting plate when the hinge arm has been mounted, in clamped position, the bolts having annular grooves in which the legs of the leg spring engage.

BRIEF DESCRIPTION OF THE DRAWINGS

The embodiments of the invention will now be described in more detail with reference to the accompanying drawings, in which.

In the various figures of the drawings, the hinge parts which do not directly relate to this invention, such as the hinge casing and the hinge links, as well as a closing mechanism, which may be provided, are not illustrated. They may be made according to the known state of the art.

DESCRIPTION OF THE PREFERRED EMBODIMENTS

Figure 1:
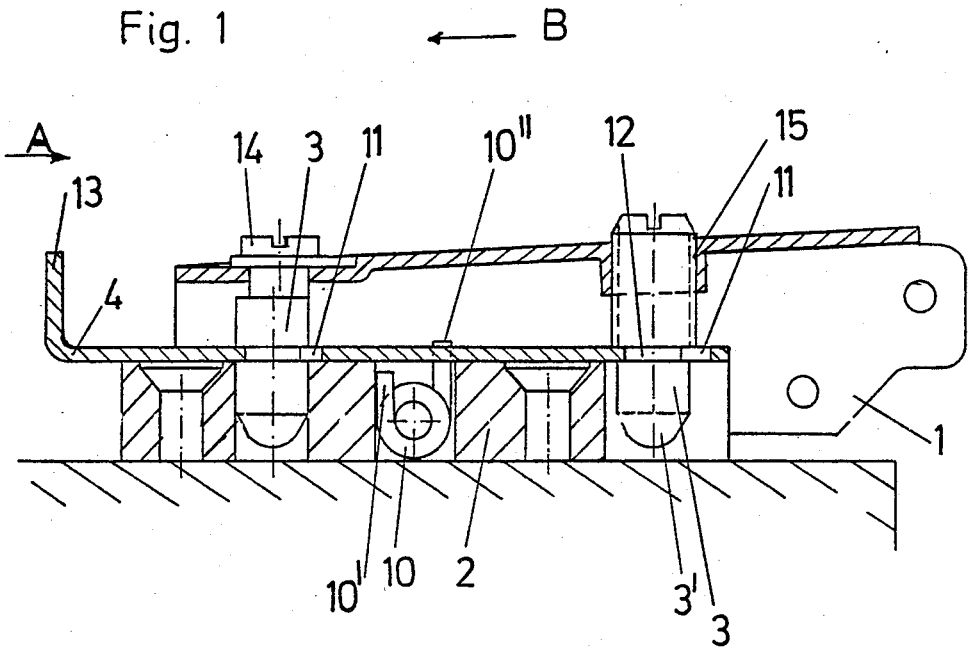
FIG. 1 is a longitudinal sectional view of a hinge arm and the mounting plate of the hinge according to the invention.
Figure 2:
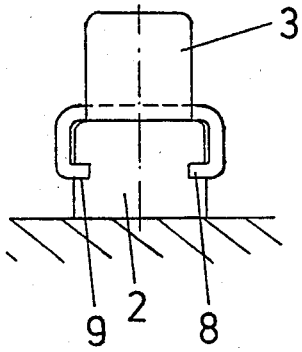
FIG. 2 is a view from the direction of arrow A of FIG. 1.
Figure 3:
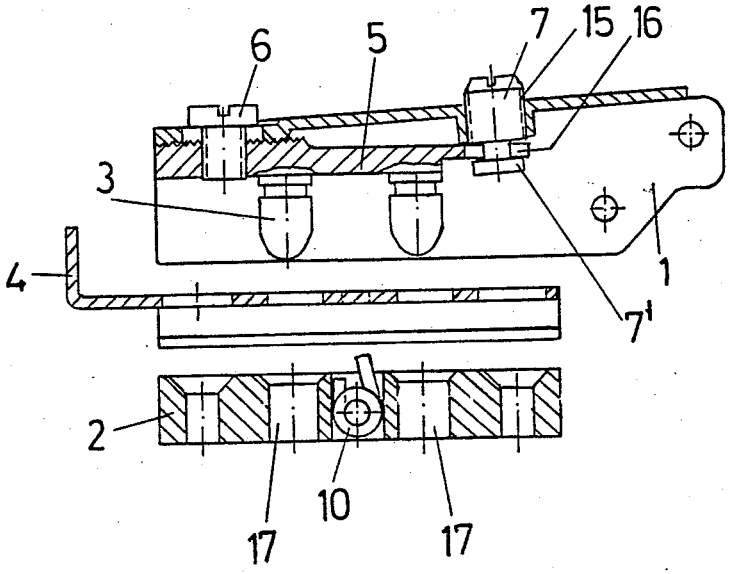
FIG. 3 is a longitudinal sectional view of a further embodiment of a hinge according to the invention with the mounting plate, the hinge arm and the mounting plate being shown spaced apart.
Figure 4:
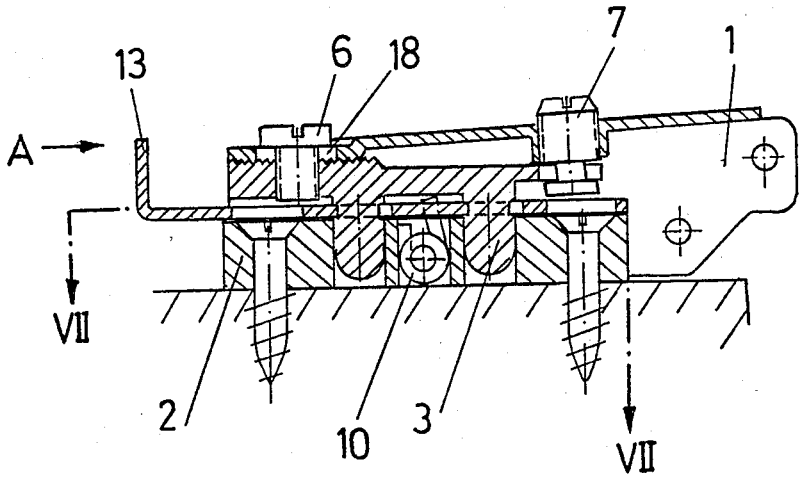
FIG. 4 is a similar longitudinal sectional view, but with the hinge arm being mounted on the mounting plate.
Figure 5:
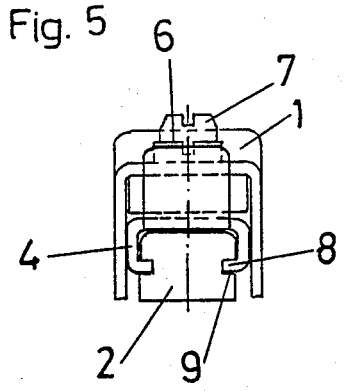
FIG. 5 is a view from the direction of arrow A of FIG. 4.

In the embodiment according to FIGS. 1 and 2, a hinge arm 1 is held on a mounting plate 2 by means of two separate rods or bolts 3. Bolts 3 replace in this arrangement, as will be described in the following, the conventional depth and joint adjustment screws.

A slide 4 which is mounted on the mounting plate 2, has a C-shaped profile, as can be seen from FIG. 2, and engages with angled edges 8 thereof in lateral grooves 9 of the mounting plate 2.

In the locked position, the slide 4 is held by a torsion or leg spring 10 which is mounted in the mounting plate 2 and abuts with a first leg 10′ on the mounting plate and with a second leg 10″ on the slide 4.

The slide has two holes 11 in the shape of keyholes.

The bolts 3 project through holes 11 in the mounted position. The bolts 3 have rounded tips 3′ which are able to displace the slide 4, when they are placed thereon, in the direction of arrow B against the spring action of the leg spring 10.

The bolts 3 further have reduced diameter portions 12, and when the latter-mentioned are aligned with or at the same height as slide 4, then the slide is displaced by the leg spring 10 in the direction of arrow A and, hence, engages the bolts 3.

Figure 7:
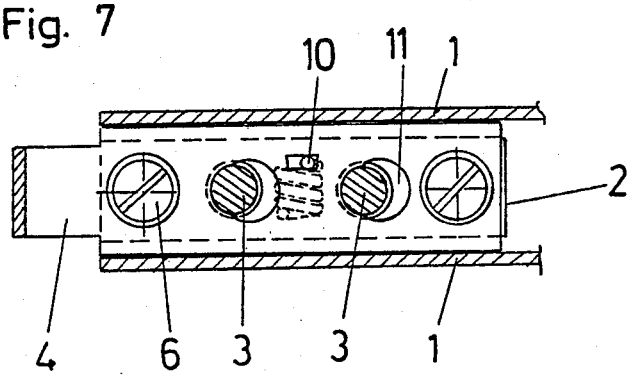
FIG. 7 is a sectional view along line VII—VII of FIG. 4.

As can be seen from FIG. 7, the bolts 3 are held by the slide 4 along a substantially semicircular portion of the periphery of each reduced diameter portion.

The displacement path of the slide 4 in the direction of arrow B can also be effected by hand by means of a handle 13. This serves to release the hinge arm 1 from the mounting plate 2.

In the embodiment according to FIG. 1, the left bolt 3 is provided with an eccentric 14, and the right bolt 3 has a thread 15 by means of which such bolt is mounted in a corresponding female thread in the hinge arm 1.

By turning the right bolt with the thread 15, the hinge arm 1 is adjusted in the direction of the width of the door joint. Turning the left bolt 3 with the eccentric 14 effects an adjustment in the direction of the depth of the hinge arm 1.

In the embodiment according to FIGS. 3 to 7, the bolts 3 are not separate parts but rather are molded to an intermediate member 5 that is held at the hinge arm 1 by means of a conventional clamping screw 6 and a joint adjustment screw 7. The joint adjustment screw 7 has, like the right bolt 3 of the embodiment according to FIG. 1, a thread 15 by means of which screw 7 is mounted in a corresponding thread of the hinge arm 1. With its head 7′, screw 7 engages behind lateral flanges 16 of the intermediate member 5, which flanges define an open-ended slot.

The parts on the side of the mounting plate, namely the mounting plate 2, the slide 4 and the leg spring 10 are designed in the same manner as described in the previous embodiment.

Mounting of the hinge arm 1 is again effected by simply pressing the hinge arm 1 and thus pressing the bolts 3 into the mounting plate 2.

It is obvious that recesses or holes 17 which receive the bolts 3 are provided in both embodiments.

In this embodiment, too, the hinge arm 1 can be released by moving the slide 4 to the left by means of its handle 13. Depth adjustment of the hinge arm 1 is effected by loosening the clamping screw 6, whereupon the hinge arm 1 can be displaced over the length of an elongated hole 18. When the desired position has been reached, the clamping screw 6 is tightened.

Adjustment in the direction of the width of the joint of the piece of furniture is effected by turning the joint adjustment screw 7.

Figure 6:
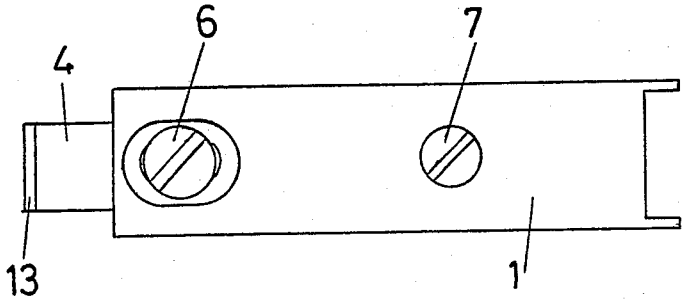
FIG. 6 is a top view of a hinge arm according to the invention.

As can be seen from FIG. 6, the outer apparance of the hinge, with the hinge arm 1 being in the mounted position, differs from conventional hinges only in that a small portion of the slide 4 with handle 13 projects from the hinge arm 1.

In the following reference now will be made to the embodiments according to FIGS 8 to 11.

The hinge part which is essential in the present invention is again the hinge arm 1 which is linked to the mounting plate 2 by means of two bolts 3. In this embodiment, the bolts 3 are at the front, i.e. right in FIG. 8, formed by a joint adjustment screw and at the rear, i.e. left in FIG. 8, by an eccentric bolt.

The bolt 3 of the joint adjustment screw is again mounted in a female thread in the hinge arm 1, and the eccentric bolt is riveted into the hinge arm 1.

Each bolt 3 is provided with a reduced diameter portion 12 designed as an annular groove into which legs 20′ of a leg spring 20 snap, when the hinge arm 1 has been placed onto the mounting plate 2.

The leg spring 20 is mounted in the mounting plate 2 in such a way that its legs 20′ extend towards the rear end of the hinge arm 1.

The legs 20′ of the leg spring 20 are urged toward each other. In the region of the bolts 3, the mounting plate 2 is provided with holes 21. Thus the bolts 3 are insertable between the legs 20′ of the leg spring 20 in the manner of push buttons.

Figure 8:
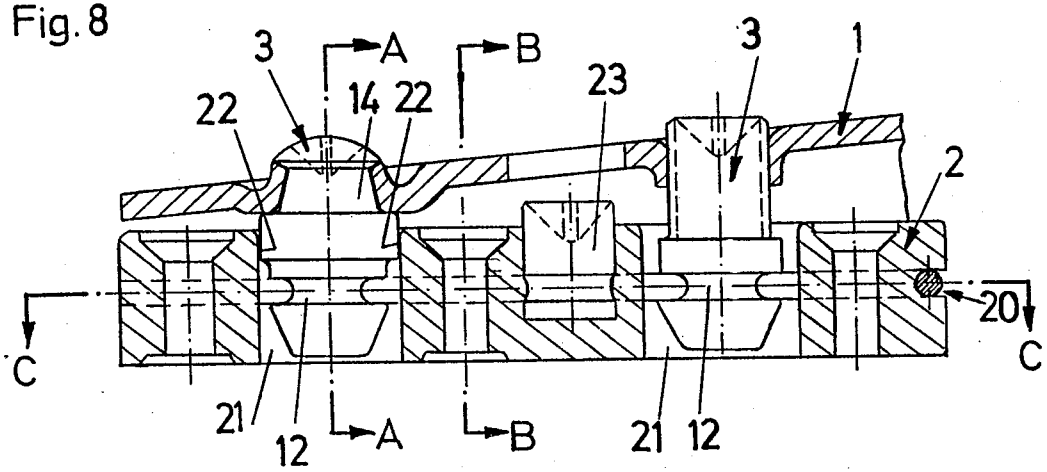
FIG. 8 is a longitudinal sectional view of a hinge arm and a mounting plate of a further embodiment of a hinge according to the invention.
Figure 10:
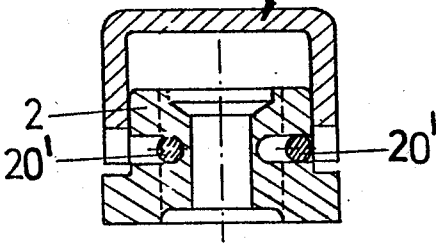
FIG. 10 is a sectional view along line X—X of FIG. 8.
Figure 9:
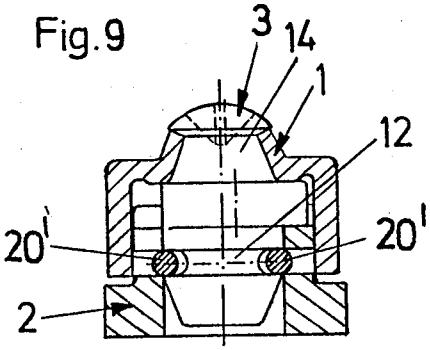
FIG. 9 is a sectional view along line IX—IX of FIG. 8.
Figure 11:
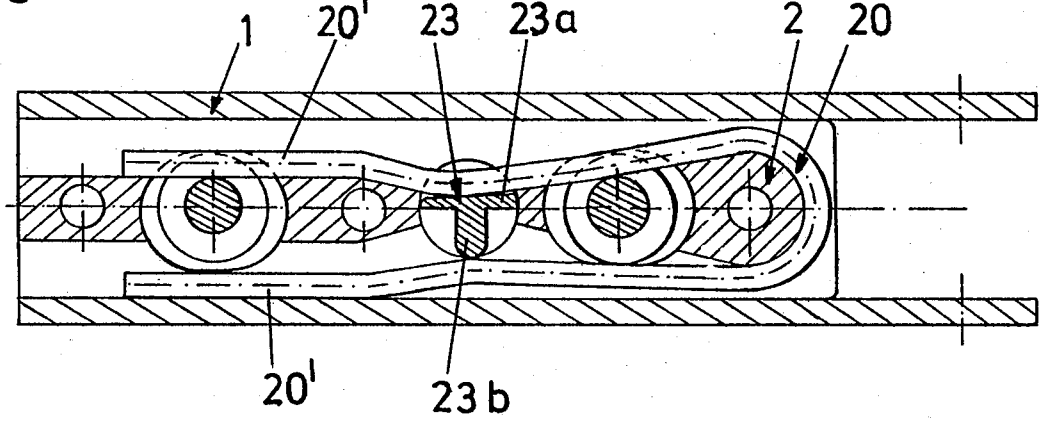
FIG. 11 is a sectional view along line XI—XI of FIG. 8.

The adjustment of the hinge arm 1 in the direction of the width of the joint of the piece of furniture is effected in a conventional manner by turning the bolt 3 which serves as the joint adjustment screw, i.e. the right bolt in FIGS. 8 and 11.

The adjustment of the hinge arm 1 in the direction of the depth of the piece of furniture is effected by turning the left bolt 3 whose eccentric portion 14 is held between two holding walls 22 of the rear hole 21.

In the illustrated embodiment, a spreader member 23 is arranged between the two bolts 3 by means of which the legs 20′ of the leg spring 20 can be preassed apart.

In FIG. 11, 23*a* designates the spreader member 23 in a position at which the legs 20′ of the leg spring 20 are locked, and 23*b* shows a dismounted position, i.e. the position of the spreader member 23 at which it presses the legs 20′ of the leg spring 20 apart.

Figure 13:
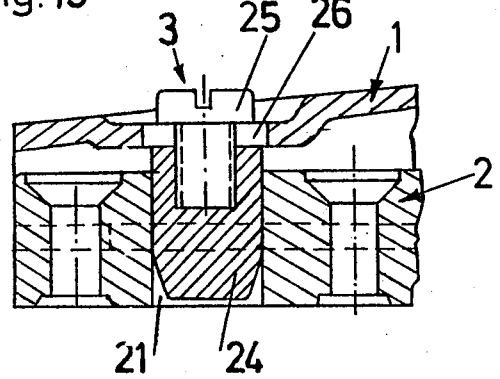
FIG. 13 shows a sectional view XIII—XIII of FIG. 12.
Figure 12:
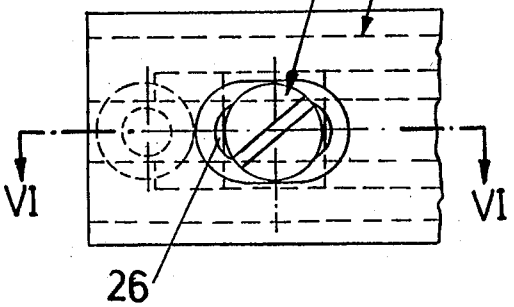
FIG. 12 is a top view of the rear region of a hinge arm in a third embodiment of the invention.

FIGS. 12 and 13 show a second possibility of mounting the hinge arm 1 in a depth-adjustment manner, i.e.

the rear bolt 3 is designed as a two-part member, comprising a bolt member 24 which is inserted into the respective hole 21 of the mounting plate 2 and pushed between the legs 20' of the leg spring 20, and a clamping screw 25 screwed therein and projecting through an elongated hole 26 in the hinge arm 1. When the clamping screw 25 is loosened, the hinge arm 1 can, in a conventional manner, be displaced in the direction of the depth of the piece of furniture. After the depth adjustment, the clamping screw 25 is tightened again.

What is claimed is:

1. In a furniture hinge of the type including a mounting plate adapted to be mounted on a furniture body to extend in a mounting plane, a hinge arm adapted to support a furniture door, and means for removably mounting said hinge arm on said mounting plate, the improvement wherein said mounting means comprises:

at least one recess formed in said mounting plate;

at least one rod attached to said hinge arm and extending therefrom, said rod being insertable into said recess in a direction transverse to said mounting plane, and said rod having formed therein a notch;

a catch member mounted on said mounting plate for sliding movement relative thereto in opposite first and second longitudinal directions parallel to said mounting plane, said catch member having therethrough at least one hole through which extends said rod when said rod is inserted into said recess;

spring means, mounted on said mounting plate and operable between said mounting plate and said catch member, for urging said catch member in said first direction, such that an edge of said catch member defining said hole engages in said notch, thereby locking said rod and thus said hinge arm to said mounting plate, said spring means comprising a torsion spring mounted within said mounting plate and having a first leg abutting said mounting plate and a second leg abutting said catch member; and means for moving said catch member in said second direction against the spring force of said spring means and thereby for removing said edge from said notch, such that said rod may be removed from said recess and said hole.

2. The improvement claimed in claim 1, comprising at least two said rods extending from said hinge arm through respective at least two said holes in said catch member and into respective at least two said recesses in said mounting plate.

3. The improvement claimed in claim 2, wherein a first said rod comprises a bolt threaded through said hinge arm for movement of said hinge arm toward and away from said mounting plate, and a second said rod is rotatable mounted in said hinge arm and includes cam means for moving said hinge arm in directions parallel to said mounting plane.

4. The improvement claimed in claim 2, wherein said rods are formed integrally with an intermediate member attached to said hinge arm by at least one screw.

5. The improvement claimed in claim 1, wherein said notch comprises a reduced diameter section extending circumferentially of said rod.

6. The improvement claimed in claim 1, wherein said hole is keyhole-shaped.

7. The improvement claimed in claim 1, wherein said catch member has a substantially C-shaped cross section in a plane transverse to said directions and includes longitudinal flanges slidably engaged in respective grooves in said mounting plate.

8. The improvement claimed in claim 1, wherein said moving means comprises a handle on said catch member.

9. In a furniture hinge of the type including a mounting plate adapted to be mounted on a furniture body to extend in a mounting plane, a hinge arm adapted to support a furniture door, and means for removably mounting said hinge arm on said mounting plate, the improvement wherein said mounting means comprises:

at least one recess formed in said mounting plate;

at least one rod attached to said hinge arm and extending therefrom, said rod being insertable into said recess in a direction transverse to said mounting plane, and said rod having formed therein a notch;

a spring member mounted in said mounting plate and having a pair of legs extending parallel to said mounting plane on opposite sides of said recess, said spring member having a spring force urging said legs toward each other in directions parallel to said mounting plane, such that said legs engage in said notch, thereby locking said rod and thus said hinge arm to said mounting plate; and means, rotatably mounted in said mounting plate, for moving said legs away from each other against said spring force and thereby for removing said legs from said notch, such that said rod may be removed from said recess.

10. The improvement claimed in claim 9, further comprising an opening through said hinge arm at a position aligned with said moving means, thereby providing access to said moving means for a tool for operating said moving means.

11. The improvement claimed in claim 9, comprising at least two said rods extending from said rod into respective at least two said recesses in said mounting plate.

12. The improvement claimed in claim 11, wherein a first said rod comprises a bolt threaded through said hinge arm for movement of said hinge arm toward and away from said mounting plate, and a second said rod is rotatably mounted in said hinge arm and includes cam means for moving said hinge arm in directions parallel to said mounting plane.

13. The improvement claimed in claim 9, wherein said notch comprises a reduced diameter section extending circumferentially of said rod.

* * * * *